United States Patent [19]

Helmintoller, Jr. et al.

[11] 3,936,230

[45] Feb. 3, 1976

[54] SELF-SUPPORTED, SELF-LOCATING SEAL FOR TURBINE ENGINES

[75] Inventors: Augustus M. Helmintoller, Jr., Loveland; Gary B. Manharth, Milford, both of Ohio

[73] Assignee: The United States of America as represented by the Secretary of the Air Force, Washington, D.C.

[22] Filed: May 9, 1974

[21] Appl. No.: 468,357

[52] U.S. Cl. ..... 416/193 R; 416/196 R

[51] Int. Cl.[2] ..... F01D 5/22

[58] Field of Search ..... 416/190, 191, 192, 193, 416/196

[56] References Cited

UNITED STATES PATENTS

| | | | |
|---|---|---|---|
| 2,999,631 | 9/1961 | Wollmershauser | 416/193 |
| 3,112,865 | 12/1963 | Gisslen | 416/193 X |
| 3,327,995 | 6/1967 | Blackhurst et al. | 416/196 |

*Primary Examiner*—Everette A. Powell, Jr.
*Attorney, Agent, or Firm*—Joseph E. Rusz; Jacob N. Erlich

[57] ABSTRACT

A self-supporting, self-locating seal having a central portion and a pair of end segments so designed as to fit within the mid span joint formed between adjacent turbine engine blades. Because of the design of the seal, the seal is held securely in position simply by its geometry and the centrifugal forces applied thereto during turbine engine operation.

1 Claim, 2 Drawing Figures

SELF-SUPPORTED, SELF-LOCATING SEAL FOR TURBINE ENGINES

BACKGROUND OF THE INVENTION

This invention relates generally to turbine engines, and, more particularly, to seals which are interposed between adjacent turbine blades.

Turbine engines have a variety of practical applications, the most important of which is in the field of aviation. In the propulsion of aircraft, the gas turbine power plant as a turbo prop or turbine jet engine has replaced the reciprocating engine in large, high speed aircraft. This change is due primary to its high power to weight ratio and its ability to be built in large horsepower sizes with high ratio of thrust per frontal area. In addition, turbine engines are useful in gas pipe line transmission, generating power in refineries and other industries as well as being useful in the marine transporation area and for the electric power generation.

The split pressure ratio design of certain turbine engines require that the outer panel flow of the turbine be sealed off from the inner panel flow, both from aerodynamic performance and mechanical reliability standpoints. Intolerably large amplitude vibratory stresses are induced in the stage two blades if the mid span joint is not sealed. The problem confronting the field is proper and reliable sealing of this mid span joint. Heretofore the joint was sealed by a simple, bonded plastic strip. Many bond failures, however, occurred in both factory and field testing, and in the production service. These seal strips became loose and extruded themselves through the opening between mid spans. As a consequence large blade stresses resulted.

SUMMARY OF THE INVENTION

The instant invention sets forth a molded plastic seal which is designed and constructed in such a manner so as to be held in place simply by its geometry and centrifugal load. There are no bond or other fastening means used.

The seal of this invention is interposed between adjacent turbine blades thereby properly sealing the mid span joint. The instant seal is of an elongated configuration having a central portion and a pair of end segments. The end segments are so designed as to fit within the opening contained within adjacent turbine blades and because of this design, the seal is securely held in position merely by its geometry and the centrifugal force thereon.

It is an object of this invention to provide a self-supporting, self-locating turbine engine seal which is of a unitary construction and needs no external securing means for its mounting between adjacent turbine blades.

It is another object of this invention to provide a self-supporting, self-locating turbine engine seal which is held in place by its geometry and the centrifugal forces applied thereto.

It is still another object of this invention to provide a self-supporting, self-locating turbine engine seal which is economical to produce and which utilizes conventional, currently available components that lend themselves to standard mass producing manufacturing techniques.

For a better understanding of the present invention together with other and further objects thereof, reference is made to the following description taken in conjunction with the accompanying drawing and its scope will be pointed out in the appended claims.

DETAILED DESCRIPTION OF THE PREFERRED EMBODIMENT

Figure 1:
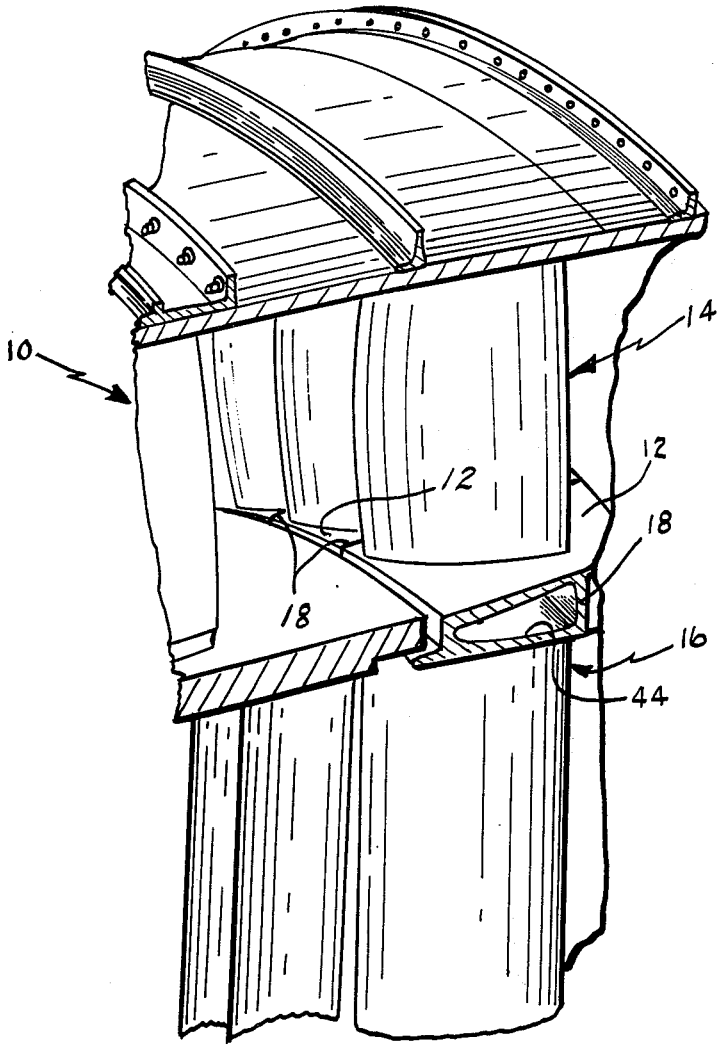
FIG. 1 is a pictorial view of a segment of a conventional two panel turbine engine showing the location of adjacent blades.

Reference is now made to FIG. 1 of the drawing which shows a portion of a conventional two panel turbine engine 10. Engine 10 is made up of a plurality of turbine blades 12 which are divided into outer panels 14 and inner panels 16. Between each adjacent blade 12 is a mid span joint portion 18 into which the self-supporting, self-locating seal 20 (see FIG. 2) of this invention is located. Seal 20 is positioned within the mid span joint 18 in order to prevent any passage of air between inner and outer panels 16 and 14 respectively.

Figure 2:
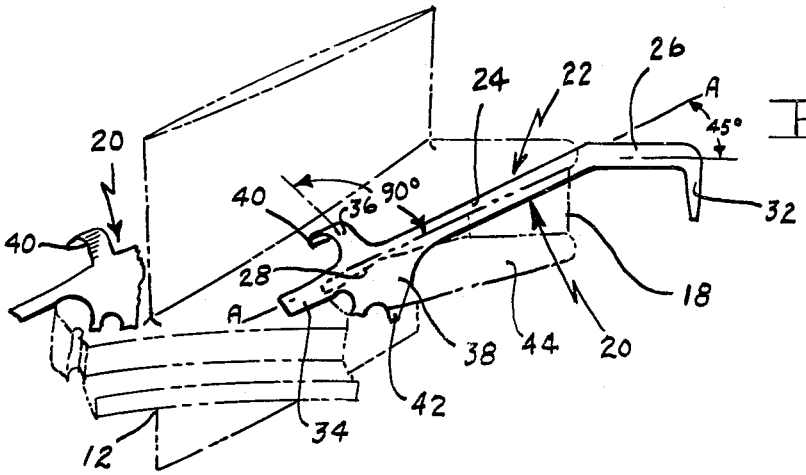
FIG. 2 is a pictorial view of the mid span joint between turbine blades (shown in phantom) showing in particular the seal of this invention (shown by solid lines) located in position at the mid span joint.

FIG. 2 best shows seal 20 of this invention. This seal 20 is made of a molded plastic construction which is in the form of an elongated body 22. Elongated body 22 has a central portion 24 lying within a preselected plane. A pair of end segments 26 and 28 extend from central portion 24. One of the end segments 26 is positioned at an angle (approximately 45°) with respect to a longitudinal axis A—A passing through central portion 24. The end portion 32 of end segment 26 extends in a direction substantially perpendicular to the plane of central portion 24.

The other end segment 28 is formed of three protrusions 34 being of a substantially rectangular configuration, 36 and 38. Protrusion 34 is an extension of central portion 24 and is located along the same lengitudinal axis A—A as central portion 24. In addition, protrusion 34 lies in the same plane as central portion 24. The second protrusion 36 is positioned at an angle (approximately 90°) with respect to the longitudinal axis A—A of central portion 24. The end 40 of second protrusion 36 extends substantially perpendicular to the plane containing central portion 24. Third protrusion 38 is located substantially opposite protrusion 36 and also has its end 42 formed in the shape of a pair of extensions extending substantially perpendicular to the plane containing central portion 24.

Seal 20 is fitted within opening 44 of turbine blade 12 while another turbine blade 12 is mounted adjacent and thereagainst. In this manner a seal is formed at mid span joint 18. In so doing, intolerably large amplitude vibratory stresses are eliminated in the two panel turbine blade structure. There are no bonding means required to hold seal 20 in position since it is held in place simply by its geometry and the centrifugal forces applied thereto during turbine engine operation.

Although this invention has been described with reference to a particular embodiment it will be understood to those skilled in the art that this invention is also capable of a variety of alternate embodiments within the spirit and scope of the appended claims.

We claim:

1. A self-locating, self-supporting seal adapted to fit within the cavity formed between the midspan joints of adjacent blades of a turbine engine comprising an elongated body formed of a synthetic plastic material having an elongated central portion and a pair of end segments, said central portion lying in a preselected plane and having a longitudinal axis, one of said end segments being of a length substantially half the length of said central portion and being positioned at substantially 45° with respect to said longitudinal axis of said central portion, said one segment having an end portion, said end portion of said one end segment lying in a plane extending substantially 90° from said plane of said central portion in order to provide a rigid support for said seal within said turbine blade cavity, said other end segment being formed of three protrusions, the first of said protrusions being of a substantially rectangular configuration and an extension of said central portion, located along said longitudinal axis of said central portion and lying completely in the same plane as said central portion, the second of said protrusions being positioned at an angle of substantially 90° with respect to said longitudinal axis of said central portion and having an end lying in a plane extending substantially 90° from the plane of said central portion, and the third of said protrusions being located substantially opposite said second protrusion and having an end having a pair of extensions thereon, said pair of extensions extending substantially 90 ° from the plane of said central portion, whereby upon positioning of said seal within the cavity formed between the midspan joints of adjacent blades of a turbine engine said end segments of said seal by their geometry, utilize the centrifugal forces acting theron to fixedly secure said seal in position.

* * * * *